US007845753B2

(12) United States Patent
Itoh

(10) Patent No.: US 7,845,753 B2
(45) Date of Patent: Dec. 7, 2010

(54) IMAGE FORMING DEVICE, TRANSPORTING CONTROL METHOD, AND COMPUTER-READABLE RECORDING MEDIUM

(75) Inventor: Yutaka Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 12/360,922

(22) Filed: Jan. 28, 2009

(65) Prior Publication Data

US 2009/0195589 A1 Aug. 6, 2009

(30) Foreign Application Priority Data

Feb. 4, 2008 (JP) ..... 2008-023782
Oct. 31, 2008 (JP) ..... 2008-282107

(51) Int. Cl.
*B41J 29/393* (2006.01)

(52) U.S. Cl. ..... 347/19; 347/101

(58) Field of Classification Search ..... 347/19, 347/101, 104, 218, 37
See application file for complete search history.

(56) References Cited

U.S. PATENT DOCUMENTS

2006/0158501 A1 7/2006 Itoh
2007/0132803 A1 6/2007 Itoh
2007/0236754 A1 10/2007 Tashiro et al.

FOREIGN PATENT DOCUMENTS

JP 10-58801 3/1998
JP 2007-160681 6/2007
JP 2007-216670 8/2007

*Primary Examiner*—Huan H Tran
(74) *Attorney, Agent, or Firm*—Oblon, Spivak, McClelland, Maier & Neustadt, L.L.P.

(57) ABSTRACT

An image forming device prints an image on a recording sheet by performing a reciprocating movement of a print head in a main scanning direction while transporting the recording sheet intermittently in a transporting direction. The image forming device is arranged to select one of a measurement value and a theoretical value based on a result of comparison between the measurement value and the theoretical value, so that the selected value is used as a value that indicates a rear-end position of the recording sheet.

12 Claims, 14 Drawing Sheets

IMAGE FORMING DEVICE, TRANSPORTING CONTROL METHOD, AND COMPUTER-READABLE RECORDING MEDIUM

BACKGROUND OF THE INVENTION

1. Field of the Invention

This invention relates to an image forming device which prints an image on a recording sheet by performing a reciprocating movement of a print head in a main scanning direction while transporting intermittently, in a sub-scanning direction, the recording sheet that is attracted to a charged transport belt by an electrostatic force.

2. Description of the Related Art

In a conventional image forming device, it is known that an image is printed on a recording sheet by performing a reciprocating movement of a print head in a main scanning direction while transporting intermittently, in a sub-scanning direction, the recording sheet that is attracted to a charged transport belt by an electrostatic force. The transport belt of this image forming device is formed of a material having a small thickness. If ink adheres to the transport belt, the electrostatic force in the ink-adhesion portion of the transport belt will be changed to the value that is insufficient for attracting the recording sheet. Consequently, the recording sheet may be lifted from the transport belt when transporting the recording sheet, and the print head may rub the surface of the recording sheet being lifted. In such a case, there is a possibility that a printed image may be blurred or the print head may be damaged.

In order to avoid this, some improvements are made in the conventional image forming device. In these improvements, the rear-end position of a recording sheet is detected and the result of the detection is used to prevent ink from being adhered to the transport belt.

For example, Japanese Laid-Open Patent Application No. 2007-216670 discloses an image forming device which is arranged to delete an image when the necessary condition for keeping ink from adhering to a transport belt is satisfied.

Japanese Laid-Open Patent Application No. 2007-160681 discloses an image forming device which is arranged to determine a rear-end position of a recording sheet based on both a rear-end position that is measured using a sensor sensing the rear-end position of the recording sheet on the transport belt, and a rear-end position that is computed using a theoretical amount of transport of the recording sheet on the transport belt.

In the image forming device of Japanese Laid-Open Patent Application No. 2007-216670, the rear-end position of the recording sheet is simply computed based on the positional relationship between the print head nozzle position and the sensor position. However, when the recording sheet is intermittently transported in the sub-scanning direction, the accuracy of detecting the rear-end position varies according to the transporting distance of the recording sheet during the intermittent transporting process. For this reason, it is difficult to detect the rear-end position accurately. In a certain case, the printing operation may be continuously performed even when the rear end position of the recording sheet is exceeded, which causes the problem of adhering ink to the transport belt.

The image forming device of Japanese Laid-Open Patent Application No. 2007-160681 is arranged so that, when a difference between the measured rear-end position obtained using the sensor and the computed rear-end position obtained using the theoretical amount of transport of the recording sheet is smaller than a threshold, the computed rear-end position obtained using the theoretical amount of transport of the recording sheet is finally selected in order to eliminate the fluctuations of the detection accuracy during the intermittent transporting process.

However, in a case in which the user erroneously sets up the size of the recording sheet with the wrong one, or in a case in which the user erroneously places the recording sheet in the wrong orientation of length and width of the recording sheet, the measured rear-end position obtained using the sensor has to be finally selected as being the rear-end position of the recording sheet.

Even in such cases, in the image forming device of Japanese Laid-Open Patent Application No. 2007-160681, the computed rear-end position obtained using the theoretical amount of transport of the recording sheet is finally selected if the difference is smaller than the threshold, which causes the problem of adhering ink to the transport belt.

SUMMARY OF THE INVENTION

In one aspect of the invention, the present disclosure provides an improved image forming device in which the above-described problems are eliminated.

In one aspect of the invention, the present disclosure provides an image forming device and a transporting control method which are able to prevent the adhesion of ink to a transport belt effectively.

In an embodiment of the invention which solves or reduces one or more of the above-mentioned problems, the present disclosure provides an image forming device which prints an image on a recording sheet by performing a reciprocating movement of a print head in a main scanning direction while transporting the recording sheet intermittently in a transporting direction, the image forming device comprising: a filler sensor disposed at an upstream position of the print head in the transporting direction to detect that the recording sheet has passed through a first position; a measurement-value computing unit configured to compute a measurement value indicating a distance from a second position of a sensor, disposed near the print head, to a rear-end position of the recording sheet in the transporting direction, by using a computed distance between the second position and the first position; a theoretical-value computing unit configured to compute a theoretical value indicating the distance from the second position to the rear-end position of the recording sheet, by using a quantity of transporting of the recording sheet; and a selecting unit configured to select one of the measurement value and the theoretical value based on a result of comparison between the measurement value and the theoretical value, so that the selected value is used as a value that indicates the rear-end position of the recording sheet.

DETAILED DESCRIPTION OF THE PREFERRED EMBODIMENTS

Figure 1:
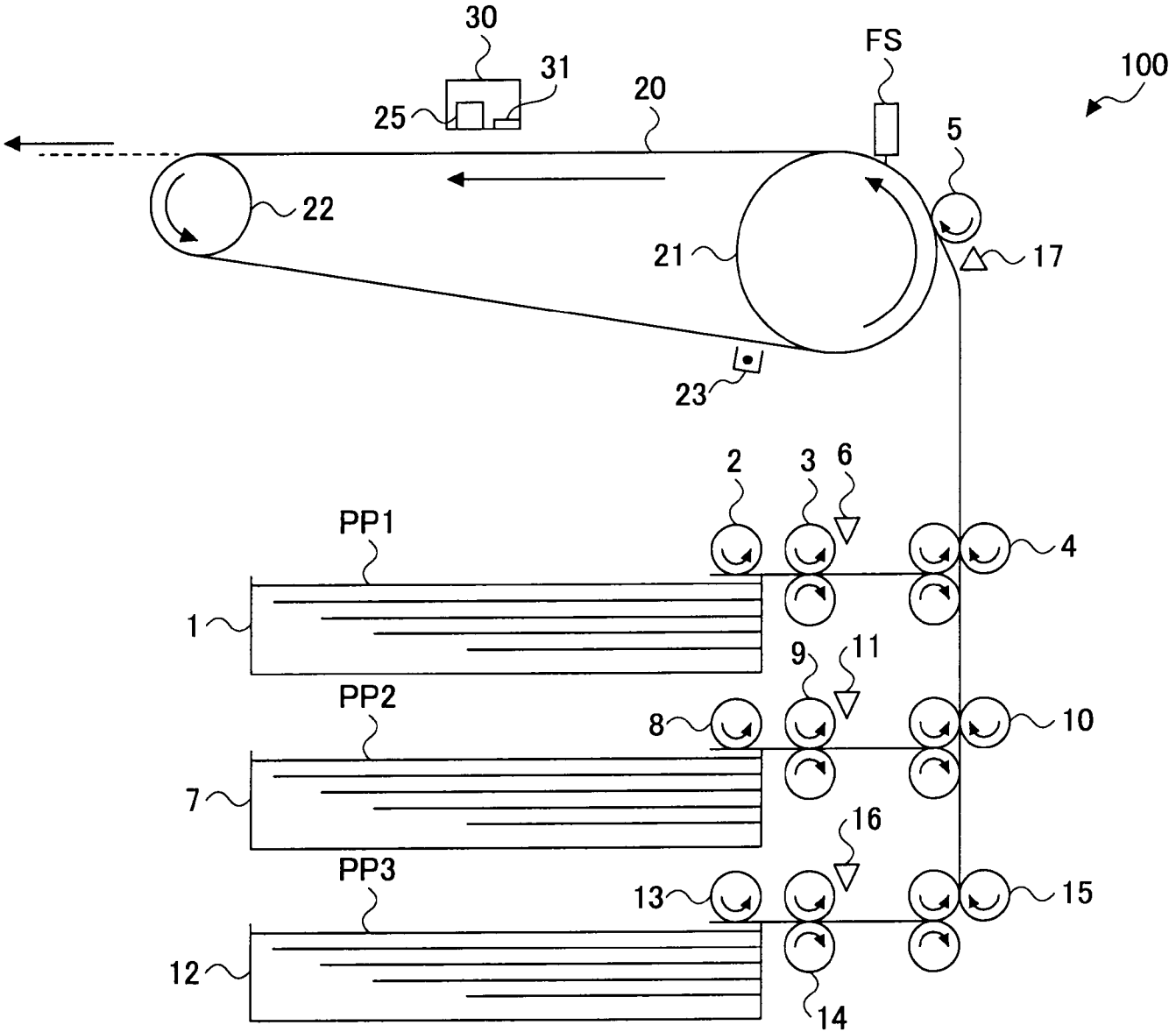
FIG. 1 is a diagram showing the outline composition of a recording sheet transporting system and an image printing system of an image forming device of a first embodiment of the invention.

An image forming device of an embodiment of the invention prints an image on a recording sheet by performing a reciprocating movement of a print head in a main scanning direction while transporting the recording sheet intermittently in a transporting direction, the image forming device including: a filler sensor disposed at an upstream position of the print head in the transporting direction to detect that the recording sheet has passed through a first position; a measurement-value computing unit configured to compute a measurement value indicating a distance from a second position of a sensor, disposed near the print head, to a rear-end position of the recording sheet in the transporting direction, by using a computed distance between the second position and the first position; a theoretical-value computing unit configured to compute a theoretical value indicating the distance from the second position to the rear-end position of the recording sheet, by using a quantity of transporting of the recording sheet; and a selecting unit configured to select one of the measurement value and the theoretical value based on a result of comparison between the measurement value and the theoretical value, so that the selected value is used as a value that indicates the rear-end position of the recording sheet.

A transporting control method of an embodiment of the invention is for use in an image forming device which prints an image on a recording sheet by performing a reciprocating movement of a print head in a main scanning direction while transporting the recording sheet intermittently in a transporting direction, the transporting control method including the steps of: providing a filler sensor disposed at an upstream position of the print head in the transporting direction to detect that the recording sheet has passed through a first position; computing a measurement value indicating a distance from a second position of a sensor, disposed near the print head, to a rear-end position of the recording sheet in the transporting direction, by using a computed distance between the second position and the first position; computing a theoretical value indicating the distance from the second position to the rear-end position of the recording sheet, by using a quantity of transporting of the recording sheet; and selecting one of the measurement value and the theoretical value based on a result of comparison between the measurement value and the theoretical value, so that the selected value is used as a value that indicates the rear-end position of the recording sheet.

A computer-readable recording medium of an embodiment of the invention stores a transporting control program which, when executed by a computer, causes the computer to perform the above-mentioned transporting control method.

It is possible for the image forming device of the embodiment of the invention to prevent the adhesion of ink to the transport belt effectively.

Other objects, features and advantages of the present invention will become more apparent from the following detailed description when read in conjunction with the accompanying drawings.

A description will be given of embodiments of the invention with reference to the accompanying drawings.

FIG. 1 is a diagram showing the outline composition of a recording sheet transporting system and an image printing system in an image forming device of a first embodiment of the invention.

In the image forming device 100 of this embodiment, a serial head type print head (for example, an ink jet printing type print head) is used to print an image on a recording sheet which is transported intermittently in a sub-scanning direction. The image forming device 100 includes three sheet trays 1, 7 and 12. The intermittent transporting is to transport a recording sheet by repetition of the process of transporting the recording sheet to a next printing position and the process of printing an image on the recording sheet while the transporting is stopped.

As shown in FIG. 1, the uppermost one of recording sheets PP1 contained in the sheet tray 1 is picked up by a pickup roller 2 and this recording sheet PP1 is delivered to a pair of transporting rollers 3. The transporting rollers 3 transport the recording sheet PP1 to a transporting roller block 4. The transporting roller block 4 changes the direction of transporting of the recording sheet PP1, received from the transporting rollers 3, to the upward transporting direction, and delivers the recording sheet PP1 to a transporting path which reaches a resist roller 5. A sheet sensor 6 is arranged to detect the recording sheet PP1 which has passed through the transporting rollers 3.

The uppermost one of recording sheets PP2 contained in the sheet tray 7 is picked up by a pickup roller 8, and this recording sheet PP2 is delivered to a pair of transporting rollers 9. The transporting rollers 9 transport the recording sheet PP2 to a transporting roller block 10. The transporting roller block 10 changes the direction of transporting of the recording sheet PP2, received from the transporting rollers 9, to the upward transporting direction, and delivers the recording sheet PP2 to the transporting path which reaches the resist roller 5. The recording sheet PP2 delivered by the transporting roller block 10 passes by the transporting roller block 4, and the transporting roller block 4 delivers the recording sheet PP2 to the transporting path which reaches the resist roller 5. A sheet sensor 11 is arranged to detect the recording sheet PP2 which has passed through the transporting rollers 8.

The uppermost one of recording sheets PP3 contained in the sheet tray 12 is picked up by the pickup roller 13 and this recording sheet PP3 is delivered to a pair of transporting rollers 14. The transporting rollers 14 transport the recording sheet PP3 to a transporting roller block 15. The transporting roller block 15 changes the direction of transporting of the recording sheet PP3, received from the transporting rollers 14, to the upward transporting direction and delivers the recording sheet PP3 to the transporting path which reaches the resist roller 5. The recording sheet PP3 delivered by the transporting roller block 15 passes by the transporting roller block 10, and the transporting roller block 10 delivers the recording sheet PP3 to the transporting path which leads to the transporting roller block 4. The transporting roller block 4 delivers the recording sheet PP3, received from the transporting roller block 10, to the transporting path which reaches the resist roller 5. A sheet sensor 16 is arranged to detect the recording sheet PP3 which has passed through the transporting rollers 13.

A sheet sensor 17 is arranged to detect each of the recording sheets PP1, PP2 and PP3 (which are delivered to the transporting path in this manner) in a position immediately before reaching the resist roller 5. Each recording sheet is then brought in contact with a nip portion between the resist roller 5 and a transport belt 20 (which will be mentioned below).

In the image forming device 100 of this embodiment, the transport belt 20 is wound between a transporting roller 21 and a transporting roller 22 and rotated in an endless manner by the rotation of the transporting rollers 21 and 22, so that each of the recording sheets PP1, PP2 and PP3 is transported in a sub-scanning direction of image printing. The surface of the transport belt 20 is charged by a charger 23 and an electrostatic force is given thereto. Then, the surface of the transport belt 20 passes by the resist roller 5 and contacts each of the recording sheets PP1, PP2 and PP3 in contact with the nip portion of the resist roller 5.

When the resist roller 5 is running in the transporting operation at this time, each of the recording sheets PP1, PP2 and PP3 is attracted to the surface of the transport belt 20 by the above-described electrostatic force. Each recording sheet is in the attracted state with the transport belt 20 and delivered to the printing position of a print head 25.

On the other hand, when the resist roller 5 is not running in the transporting operation (or when operation of the resist roller 5 is stopped) at this time, each of the recording sheets PP1, PP2 and PP3 is held in a waiting state in which each recording sheet is in contact with the nip portion of the resist roller 5 at this position. Namely, in this case, the transporting of each of the recording sheets PP1, PP2 and PP3 is stopped.

The print head 25 is carried on a carriage 30, and the carriage 30 on which the print head 25 is moved in a main scanning direction of image printing in a reciprocating manner, so that a serial head type image formation is carried out with the print head 25 on the carriage 30. In the carriage 30, a reflection-type optical sensor 31 is arranged to irradiate a detection light beam on the transport belt 20 and detect a reflected light beam from the transport belt 20.

Moreover, in the image forming device 100 of this embodiment, a filler sensor FS is arranged at an upstream position of the print head 25 in the transporting direction to detect the rear-end of a recording sheet. The filler sensor FS detects whether each of the recording sheets PP1, PP2 and PP3 has passed through the filler sensor FS, depending on the presence of each of the recording sheets PP1, PP2 and PP3. For example, the filler sensor FS includes a filler (not shown), and, when the filler touches the surface of each of the recording sheets PP1, PP2 and PP3 on the transport belt 20, the output signal of the filler sensor FS is set in an ON state. When the filler does not touch the surface of each of the recording sheets PP1, PP2 and PP3 on the transport belt 20, the output signal of the filler sensor FS is set in an OFF state. The filler sensor FS is well known in the art and a description thereof will be omitted.

Figure 2:
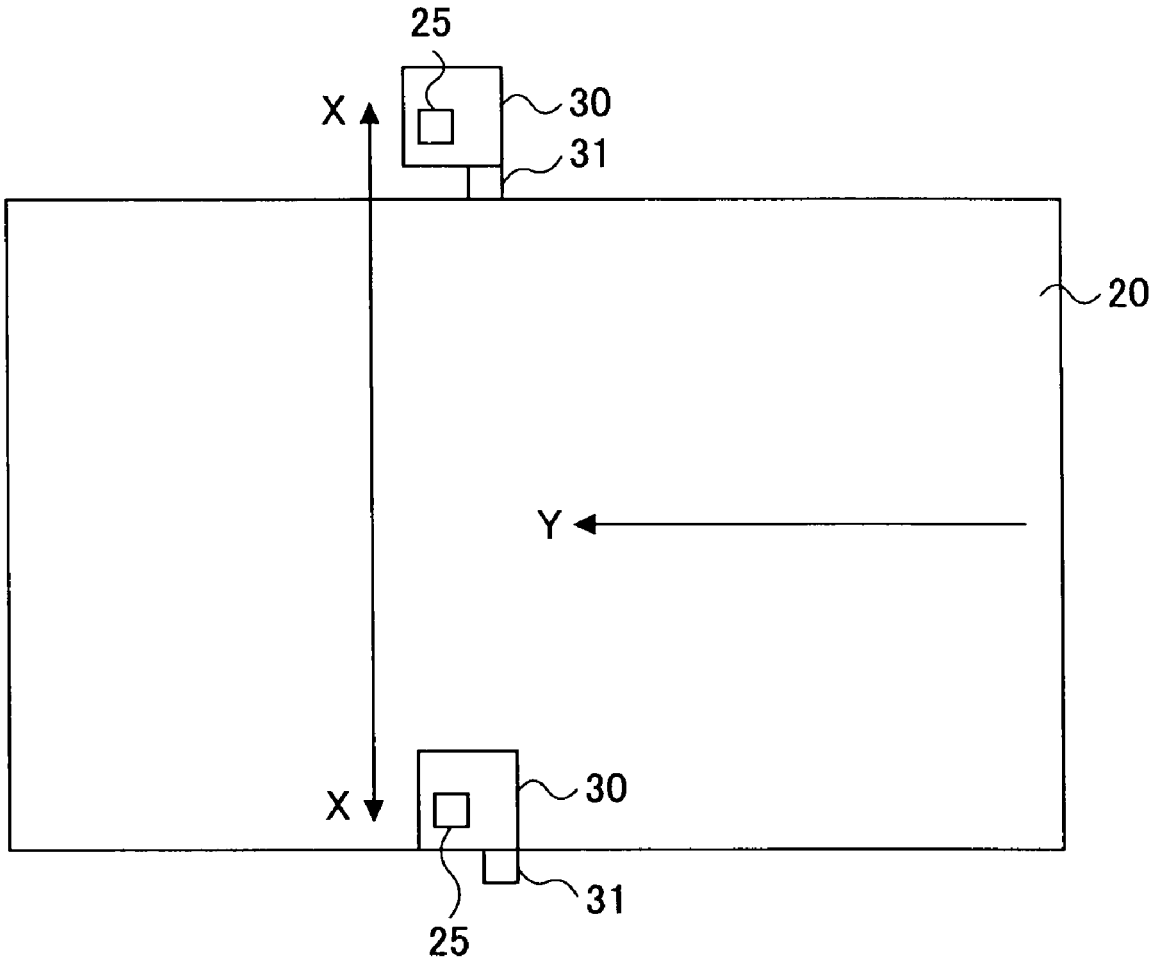
FIG. 2 is a diagram for explaining the main scanning direction and the sub-scanning direction in the image forming device of the first embodiment.

FIG. 2 is a diagram for explaining the main scanning direction and the sub-scanning direction in the image forming device of the first embodiment.

As shown in FIG. 2, the main scanning direction in the image forming device 100 of this embodiment is the direction indicated by the arrow X-X in FIG. 2, which direction is perpendicular to the transporting direction of the transport belt 20. As shown in FIG. 2, the sub-scanning direction in the image forming device 100 of this embodiment is the direction indicated by the arrow Y in FIG. 2, which direction is parallel to the transporting direction of the transport belt 20. The carriage 30 is moved in the direction indicated by the arrow X-X (which is the main scanning direction) in a reciprocating manner so that the carriage 30 performs a reciprocating movement of the print head 25.

The control of the recording sheet transporting system and the image printing system in the image forming device 100 of this embodiment is carried out in accordance with the program which controls the image forming device 100. Next, the hardware composition of the image forming device 100 which is needed in order to execute the program will be described.

Figure 3:
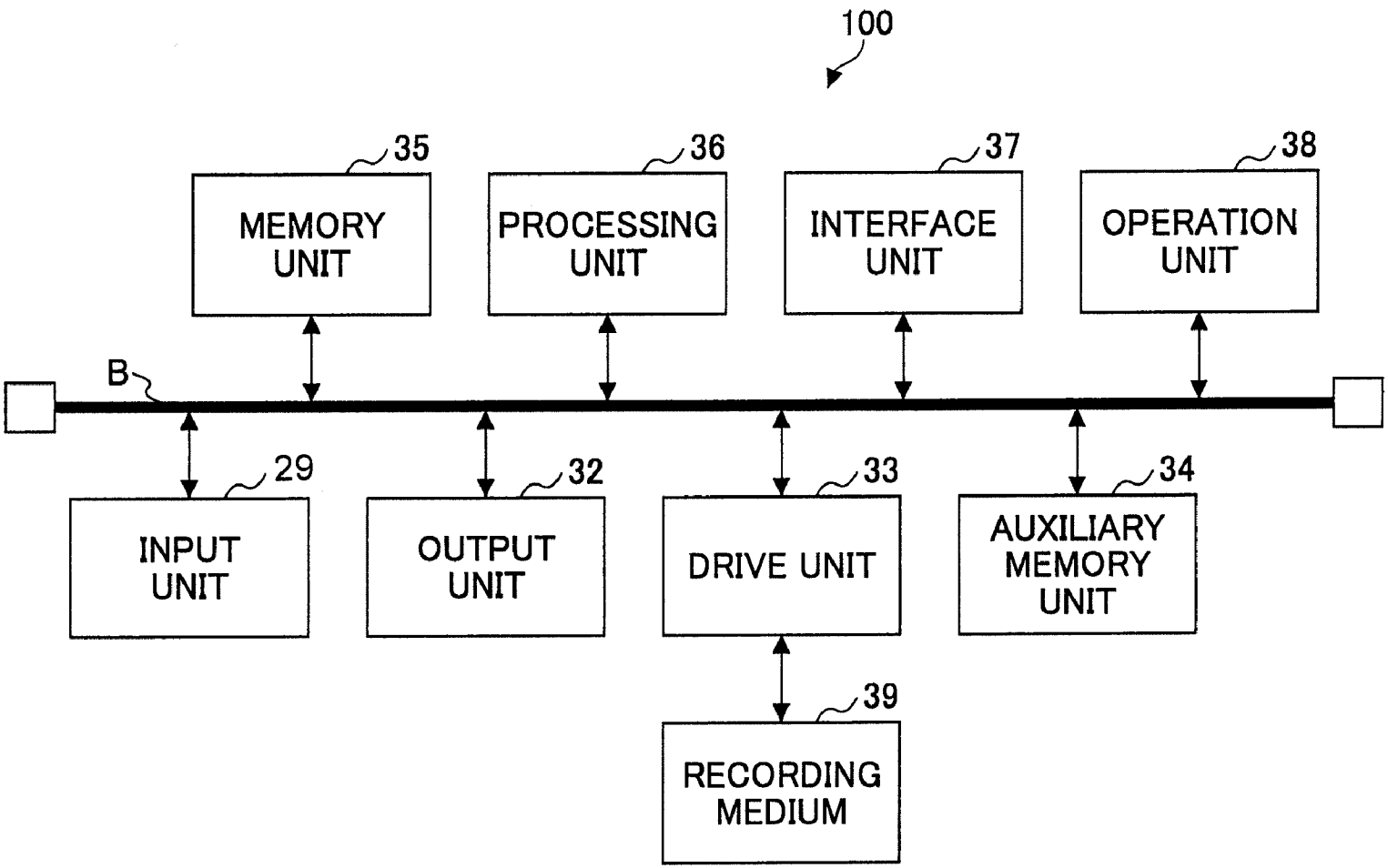
FIG. 3 is a block diagram showing the hardware composition of the image forming device of the first embodiment.

FIG. 3 is a block diagram showing the hardware composition of the image forming device of the first embodiment.

As shown in FIG. 3, the image forming device 100 includes an input unit 29, an output unit 32, a drive unit 33, an auxiliary memory unit 34, a memory unit 35, a processing unit 36, an interface unit 37, and an operation unit 38, which are interconnected by a bus B.

The input unit 29 is a device for inputting image data. For example, the input unit 29 may be constituted by a scanning device or the like. The output unit 32 is a device for outputting image data. For example, the output unit 32 may be constituted by a plotter device or the like. The interface unit 37 is constituted by any of a modem, a LAN card, etc., and the interface unit 37 is used in order to allow the image forming device 100 to be connected to a network. The operation unit 38 is a device for operating the image forming device 100. For example, the operation unit 38 may be constituted by an operation panel having a displaying capability.

A transporting control program of an embodiment of the invention is included in the image forming device 100 as a part of various programs which control the image forming device 100. This transporting control program may be supplied by distribution of a recording medium 39 or by downloading of the program from the network. The recording medium 39 storing the transporting control program is a computer-readable recording medium which is any of an optical disc, a magnetic disc, a semiconductor memory, a ROM, a flash memory, a CD-ROM, a flexible disk, a magneto-optical disc, etc.

When the recording medium 39 storing the transporting control program is set in the drive unit 33, the transporting control program from the recording medium 39 is installed in the auxiliary memory unit 34 via the drive unit 33. Alternatively, when the transporting control program is downloaded from the network, the downloaded transporting control program is installed in the auxiliary memory unit 34 via the interface unit 37.

The auxiliary memory unit 34 stores the installed transporting control program. In the auxiliary memory unit 34, a data storage area is arranged, and, in the data storage area, the values predefined in the image forming device 100 and the values computed based on the result of data processing are stored.

Upon starting of operation of the image forming device 100, a transporting control program is read from the auxiliary memory unit 34 and stored in the memory unit 35. The processing unit 36 performs the transporting control method of an embodiment of the invention (which will be described later) in accordance with the transporting control program stored in the memory unit 35.

Figure 4:
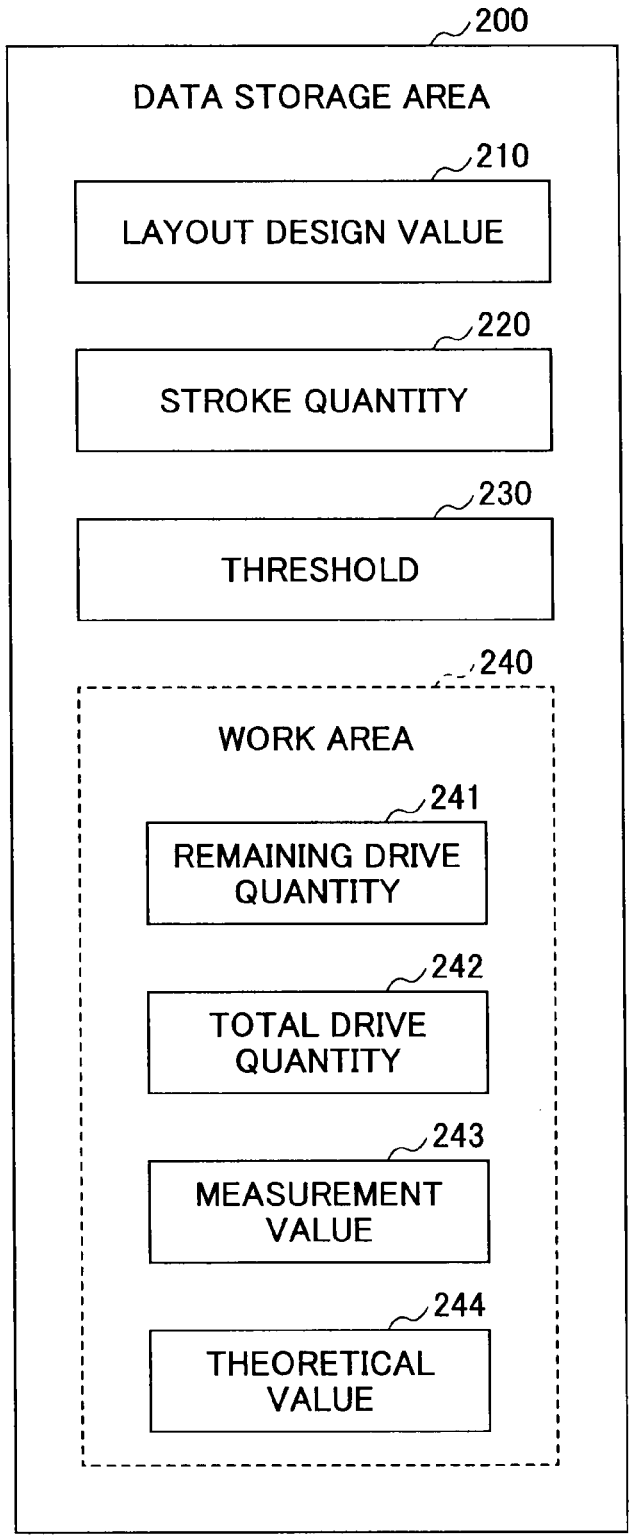
FIG. 4 is a block diagram showing the composition of a data storage area in an auxiliary memory unit of the image forming device of the first embodiment.

Next, the data storage area arranged in the auxiliary memory unit 34 will be described. FIG. 4 is a block diagram showing the composition of the data storage area arranged in the auxiliary memory unit of the image forming device of the first embodiment.

The data storage area 200 is arranged in the auxiliary memory unit 34 of the image forming device 100 of this embodiment. As shown in FIG. 4, in the data storage area 200, a layout design value 210, a stroke quantity 220, and a threshold 230 are stored beforehand. The layout design value 210 and the stroke quantity 220 are the values used in the computation of a measurement value, which will be described later.

The threshold 230 is a reference value that is used for selecting one of a measurement value and a theoretical value. The details of the measurement value and the theoretical value and the details of the selection will be described later.

Moreover, in the data storage area 200, a work area 240 is also arranged, and, in the work area 240, the data obtained by the result of computation in the image forming device 100 is stored temporarily. Specifically, in the work area 240, a remaining drive quantity 241, a total drive quantity 242, a measurement value 243, and a theoretical value 244 are stored.

Figure 5:
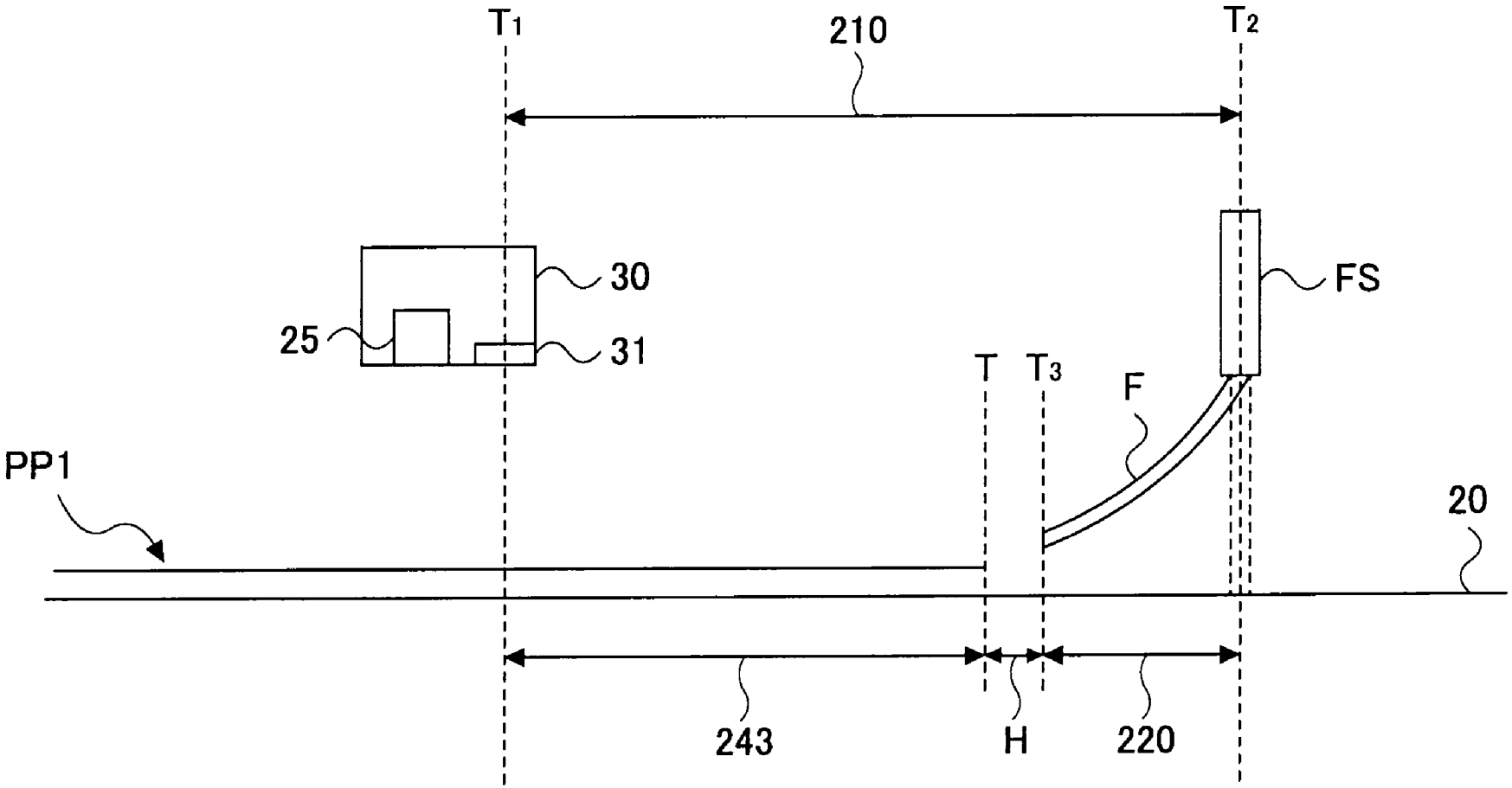
FIG. 5 is a diagram for explaining a measurement value and a theoretical value.

Next, the measurement value and the theoretical value in this embodiment will be described. FIG. 5 is a diagram for explaining a measurement value and a theoretical value. It is assumed that FIG. 5 illustrates the condition of a recording sheet PP1 in which the recording sheet PP1 is transported by the transport belt 20 and, after the recording sheet PP1 passes through the filler sensor FS and is moved to a position at a distance H from the filler sensor FS, the rear end of the recording sheet PP1 in a stop state is located at a position T.

In the example of FIG. 5, the case of the recording sheet PP1 is illustrated. Alternatively, either the recording sheet PP2 or the recording sheet PP3 may be used instead of the recording sheet PP1.

A position T1 shown in FIG. 5 is a position where the refection-type optical sensor 31 detects a reflected light beam from the transport belt 20, which position is equivalent to a second position recited in the claims. A position T2 shown in FIG. 5 is a position of the filler F where the filler F in the filler sensor FS is in a stop state, which position is equivalent to a first position recited in the claims. A position T3 shown in FIG. 5 denotes a position where the filler F is separated from the recording sheet PP1.

The position T1 in this embodiment is described as being the position where the refection-type optical sensor 31 detects a reflected light beam from the transport belt 20. Alternatively, the position T1 may be a position where the reflection-type optical sensor 31 irradiates a detection light beam on the transport belt 20.

In this embodiment, a computation value (which indicates a length in the recording sheet PP1 between the position T1 and the rear-end position T) that is computed based on the layout design value 210 (which indicates a distance between the position T1 and the position T2), the stroke quantity 220 of the filler sensor FS and the distance H is called the measurement value 243. The measurement value 243 is equal to the value obtained by subtracting the sum of the stroke quantity 220 of the filler sensor FS and the distance H from the layout design value 210.

In this embodiment, a computation value (which indicates a length in the recording sheet PP1 between the position T1 and the rear-end position T) that is computed based on the length in the sub-scanning direction of the recording sheet PP1 and the transport quantity of the recording sheet PP1 is called the theoretical value 244. The theoretical value 244 is equal to the value obtained by subtracting the length of the recording sheet PP1, corresponding to the transport quantity, from the length in the sub-scanning direction of the recording sheet PP1.

The layout design value 210 is a value that is predetermined at the time of the design of the image forming device 100. The layout design value 210 is stored beforehand in the data storage area 200.

The stroke quantity 220 is a value that is determined according to the characteristics of the filler sensor FS. The stroke quantity 220 is stored beforehand in the data storage area 200. The stroke quantity 220 is produced as a result of pulling the filler F by the recording sheet PP1 when the recording sheet PP1 passes through the filler sensor FS. The stroke quantity 220 indicates a distance between the position T2 where the filler F is in a stop state and the position T3 where the filler F is separated from the recording sheet PP1. The filler sensor FS is set in an OFF state when the recording sheet PP1 separates from the filler F.

In this embodiment, when the filler sensor FS is in an OFF state continuously over a period of a predetermined time, the OFF state of the filler sensor FS is determined. When the OFF state of filler sensor FS is determined, the system control part 300 determines that the recording sheet PP1 has passed through the filler sensor FS.

The distance H is obtained when the process of computing the measurement value 243 is performed. The distance H indicates a distance by which the recording sheet PP1 is transported from a time after the recording sheet PP1 separates from the filler sensor FS to a time the recording sheet PP1 is set in a stop state.

In this embodiment, the distance H can be computed based on the drive quantity of the motor which drives the transporting rollers 21 and 22. The transport belt 20 performs intermittent transporting of the recording sheet PP1 when the transporting rollers 21 and 22 are driven by the motor. Therefore, the distance H of the recording sheet PP1 is equivalent to the drive quantity of the motor. In this embodiment, the distance H is computed based on the remaining drive quantity of the motor that transports the recording sheet PP1. The remaining drive quantity of the motor indicates the drive quantity of the motor up to a time the motor is stopped.

In the filler sensor FS, the filler F is vibrated even after the filler F is separated from the recording sheet PP1. For this reason, chattering of detection of the recording sheet PP1 occurs even after the recording sheet PP1 separates from the filler F.

In order to avoid the influence of chattering, in this embodiment, a predetermined time for absorbing the influence of chattering (which will be called "chattering absorption time") is provided. In this embodiment, when a time the OFF state of the filler sensor FS is continuously detected exceeds the chattering absorption time, the OFF state of the filler sensor FS is determined. The chattering absorption time in many cases is set to a time on the order of 10 ms to 100 ms.

Transporting of the recording sheet PP1 is continuously performed during the chattering absorption time. Therefore, when the OFF state of the filler sensor FS is determined, the rear-end position T of the recording sheet PP1 is moved to a downstream position of the position T3 where the filler F is separated from the recording sheet PP1. The distance by which the recording sheet PP1 is transported during the chattering absorption time (which is called chattering transporting distance) is a fixed value that is determined according to the characteristics of the filler sensor FS. It is assumed in this embodiment that the value of the chattering transporting distance is included in the above-described stroke quantity 220.

Accordingly, the distance H in this embodiment means the distance by which the recording sheet PP1 is transported after the OFF state of the filler sensor FS is determined.

In this embodiment, the value of the chattering transporting distance is included in the stroke quantity 220. Alternatively, the distance H may be computed with the stroke quantity 220 that does not include the chattering transporting distance. In this case, the distance H is computed as a sum of the transporting distance of the recording sheet PP1, corresponding to the remaining drive quantity of the motor at the time of determination of the OFF state of the filler sensor FS, and the chattering transporting distance.

Next, the theoretical value 244 will be described.

As described above, the distance by which the recording sheet PP1 is transported is equivalent to the drive quantity of the motor. Therefore, the theoretical value 244 in this embodiment is obtained by subtracting, from the length of the recording sheet PP1 in the sub-scanning direction, the distance by which the recording sheet PP1 is transported by the total drive quantity of the motor from a motor start to a motor stop.

Figure 6:
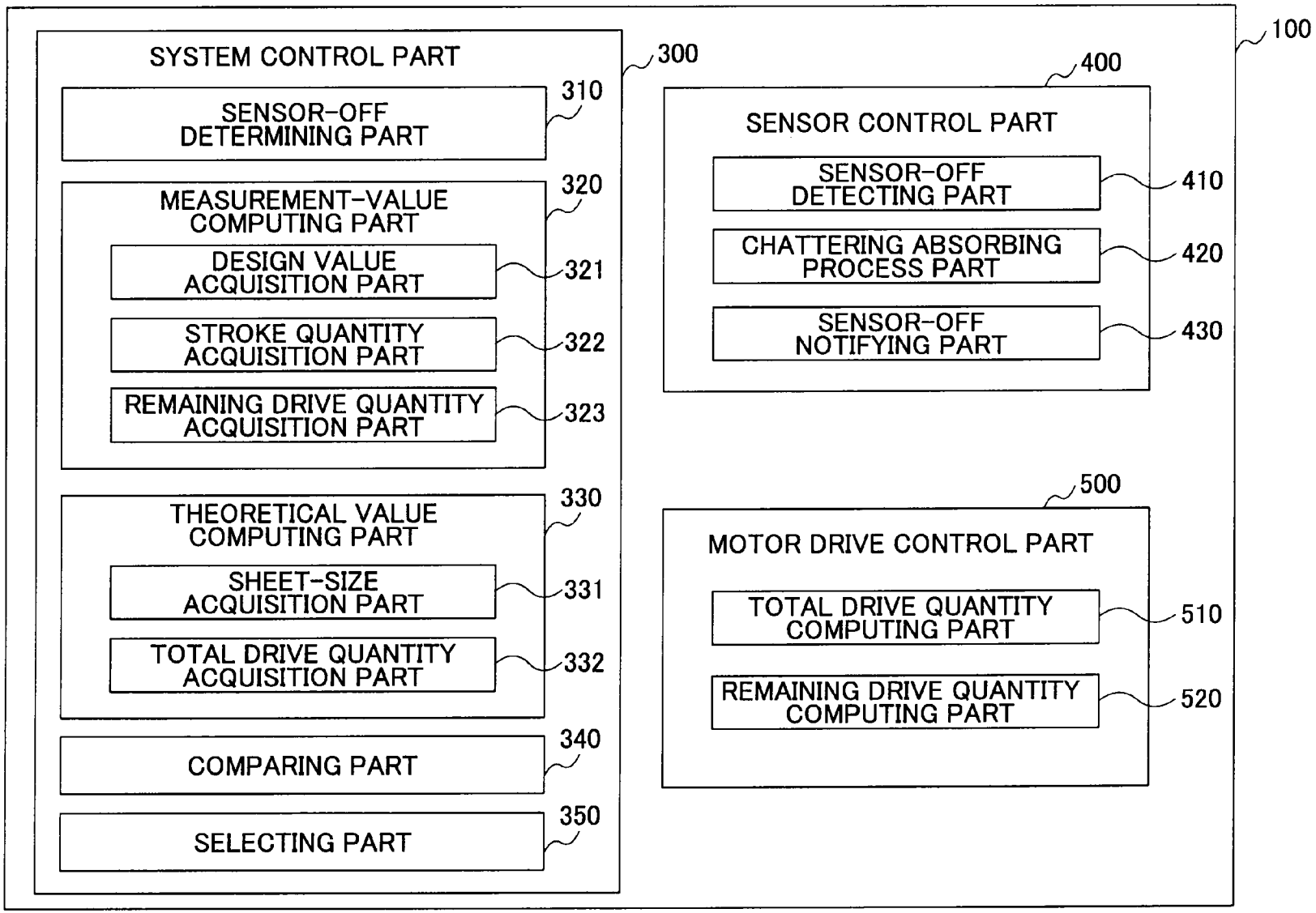
FIG. 6 is a block diagram showing the functional composition of the image forming device of the first embodiment.

Next, the functional composition of the image forming device 100 of this embodiment will be described. FIG. 6 is a block diagram showing the functional composition of the image forming device 100 of this embodiment.

As shown in FIG. 6, the image forming device 100 of this embodiment includes a system control part 300, a sensor control part 400, and a motor drive control part 500.

The system control part 300 performs control of the recording sheet transporting system and the image printing system of the image forming device 100. The system control part 300 includes a sensor-off determining part 310, a measurement-value computing part 320, a theoretical-value computing part 330, a comparing part 340, and a selecting part 350.

The sensor-off determining part 310 determines the sensor-off state when a sensor-off signal is received from the sensor control part 400.

The measurement-value computing part 320 computes the measurement value 243 which indicates the rear-end position of the recording sheet transported by the transport belt 20.

The measurement-value computing part 320 in this embodiment includes a design value acquisition part 321, a stroke quantity acquisition part 322, and a remaining drive quantity acquisition part 323. The design value acquisition part 321 acquires the layout design value 210 which is stored in the data storage area 200. The stroke quantity acquisition part 322 acquires the stroke quantity 220 which is stored in the data storage area 200. The remaining drive quantity acquisition part 323 acquires the remaining drive quantity 242 which is computed by the motor drive control part 500.

When the layout design value 210, the stroke quantity 220, and the remaining drive quantity 242 are acquired, the measurement-value computing part 320 subtracts from the layout design value 210 the distance H that is computed based on the stroke quantity 220 and the remaining drive quantity 242, so that the measurement value 243 is computed. The computed measurement value 243 is stored in the work area 240. The layout design value 210, the stroke quantity 220, and the distance H are expressed in millimeters.

The theoretical-value computing part 330 computes the theoretical value 244 which indicates the rear-end position of the recording sheet transported by the transport belt 20.

The theoretical-value computing part 330 in this embodiment includes a sheet-size acquisition part 331 and a total drive quantity acquisition part 323. The sheet-size acquisition part 331 acquires information (which is called size information) which indicates the size of the recording sheet arranged in the image forming device 100. For example, the size information is information which includes the length in the main scanning direction of the recording sheet and the length in the sub-scanning direction of the recording sheet. The size information is stored beforehand in the auxiliary memory unit 34.

The sheet-size acquisition part 331 acquires standard size information by making reference to the sheet size which is set up by the user from the operation unit 38. The total drive quantity acquisition part 332 acquires the total drive quantity 242 from the motor drive control part 500.

When the size information and the total drive quantity 242 are acquired, the theoretical-value computing part 330 computes the theoretical value 244 by subtracting from the sheet size (the length in the sub-scanning direction of the recording sheet) the length of the recording sheet which is transported by the total drive quantity 242. The computed theoretical value 244 is stored in the work area 240.

The comparing part 340 compares the measurement value 243 and the theoretical value 244 and determines the relationship in the magnitude between the measurement value 243 and the theoretical value 244. The selecting part 350 selects one of the measurement value 243 and the theoretical value 244 based on the result of the comparison by the comparing part 340.

The sensor control part 400 controls the sensors arranged in the image forming device 100. For example, the sensors controlled by the sensor control part 400 in this embodiment include the reflection-type optical sensor 31 and the filler sensor FS.

The sensor control part 400 mainly performs control for determining the OFF state of the filler sensor FS. The sensor control part 400 includes a sensor-off detecting part 410, a chattering absorbing process part 420, and a sensor-off notifying part 430.

The sensor-off detecting part 410 detects that the filler sensor FS is in an OFF state. The chattering absorbing process part 420 performs a chattering absorbing process for absorbing the chattering until the OFF state of the filler sensor FS is determined. The chattering absorbing process may be performed by detecting whether the filler sensor FS is in an OFF state continuously over a period of a predetermined time, so as to avoid notifying the ON state/OFF state of the filler sensor FS to the system control part 300 until the OFF state of the filler sensor FS is determined.

After the chattering absorbing process by the chattering absorbing process part 420 is completed, the sensor-off notifying part 430 notifies the system control part 300 that the OFF state of the filler sensor FS is determined. The sensor-off notifying part 430 may notify the motor drive control part 500 that the OFF state of the filler sensor FS is determined.

In this embodiment, the sensor-off notifying part 430 notifies the system control part 300 that the OFF state of the filler sensor FS is determined. Alternatively, the system control part 300 may determine the OFF state of the filler sensor FS by performing a polling process on the filler sensor FS.

The motor drive control part 500 controls the drive of the motor arranged in the image forming device 100. For example, the motor controlled by the motor drive control part 500 in this embodiment includes the motor (not shown) for driving the transporting rollers 21 and 22 which transport the recording sheet.

The motor drive control part 500 includes a total drive quantity computing part 510 and a remaining drive quantity computing part 520. The total drive quantity computing part 510 computes the total drive quantity 242. The total drive quantity 242 computed by the total drive quantity computing part 510 indicates the drive quantity of the motor from a time the front end of the recording sheet is detected by the reflection-type optical sensor 31 to a time the OFF state of the filler sensor FS is determined. The computed total drive quantity 242 is stored in the work area 240.

The remaining drive quantity computing part 520 computes the remaining drive quantity 241 of the motor. The remaining drive quantity computing part 520 computes the remaining drive quantity 241 by subtracting the already consumed drive quantity of the motor from the drive quantity of the motor needed from a motor start to a motor stop in the intermittent transporting. The remaining drive quantity computing part 520 in this embodiment computes the remaining drive quantity when the OFF state of the filler sensor FS is detected by the sensor-off detecting part 410.

When the chattering transporting distance is not included in the stroke quantity 220, the remaining drive quantity computing part 520 may compute the remaining drive quantity when the state of the filler sensor FD is changed from an ON state to an OFF state.

Figure 7:
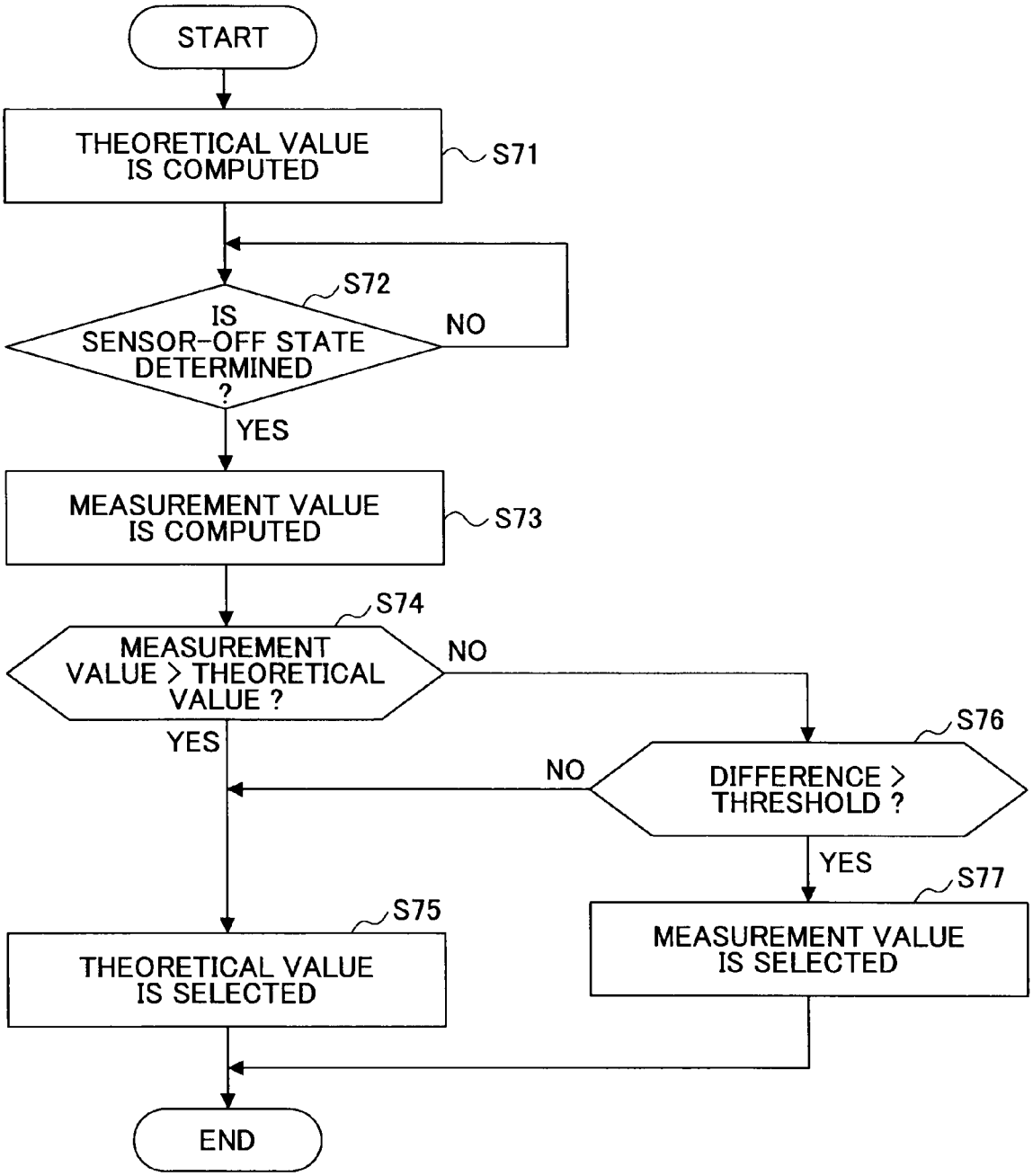
FIG. 7 is a flowchart for explaining operation of the image forming device of the first embodiment.

Next, operation of the image forming device 100 of this embodiment will be described. FIG. 7 is a flowchart for explaining operation of the image forming device of the first embodiment.

In the image forming device 100 of this embodiment, one of the measurement value 243 and the theoretical value 244 is selected based on the relationship in the magnitude between the measurement value 243 and the theoretical value 244, and the selected value is used to detect the rear-end position T of the recording sheet PP1.

When the transporting of the recording sheet PP1 by the transport belt 20 is started, the theoretical-value computing part 330 of the system control part 300 receives the size information of the recording sheet PP1 acquired by the sheet-size acquisition part 331. The theoretical-value computing part 330 receives the total drive quantity 242 which is serially computed by the total drive quantity computing part 510 of the motor drive control part 500 and acquired by the total drive quantity acquisition part 332. And the theoretical-value computing part 330 serially computes the theoretical value 244 based on the size information and the total drive quantity 242 (step S71).

The system control part 300 determines whether the sensor-off determining part 310 receives the notice indicating that the OFF state of filler sensor FS is determined, from the sensor-off notifying part 430 of the sensor control part 410 (step S72). When the sensor-off determining part 310 receives the notice from the sensor-off notifying part 430, the system control part 300 determines that the rear-end of the recording sheet PP1 has passed through the filler sensor FS.

After the OFF state of the filler sensor FS is determined, the system control part 300 computes the measurement value 243 by using the measurement-value computing part 320 (step S73). Specifically, the measurement-value computing part 320 receives the layout design value 210 acquired from the data storage area 200 by the design value acquisition part 321, and receives the stroke quantity 220 acquired by the stroke quantity acquisition part 322. Moreover, the measurement-value computing part 320 receives the remaining drive quantity 241 computed by the remaining drive quantity computing part 520 of the motor drive control part 500. Then, the measurement value 243 is computed based on the layout design value 210, the stroke quantity 220, and the remaining drive quantity 241.

Next, the system control part 300 causes the comparing part 340 to compare the theoretical value 244 obtained when the OFF state of the filler sensor FS is determined with the measurement value 243 computed in the step S73, and determines whether the condition: the measurement value 243>the theoretical value 244 is satisfied (step S74).

When the condition: the measurement value 243>the theoretical value 244 is satisfied in the step S74, the selecting part 350 selects the theoretical value 244 as a value that is used to detect the rear-end position T of the recording sheet (step S75).

When the condition: the measurement value 243>the theoretical value 244 is not satisfied in the step S74, the comparing part 340 determines a difference between the measurement value 243 and the theoretical value 244. The comparing part 340 compares the difference with the threshold 230 stored in the data storage area 200, and determines whether the condition: the difference>the threshold 230 is satisfied (step S76).

When the condition: the difference>the threshold 230 is satisfied in the step S76, the selecting part 350 selects the measurement value 243 as a value that is used to detect the rear-end position T of the recording sheet (step S77).

When the condition: the difference>the threshold 230 is not satisfied in the step S76, the control is transferred to the step S75 in which the selecting part 350 selects the theoretical value 244.

In this manner, when the condition: the measurement value 243>the theoretical value 244 is satisfied in the step S74, the image forming device 100 of this embodiment determines the rear-end position T of the recording sheet PP1 by using the theoretical value 244 which is the smaller value.

As a result, the smaller value of the distance between the position T1 and the rear-end position T indicates the rear-end position T in the image forming device 100 accurately, and it is possible to reduce a possibility that the print head 25 discharge ink after the recording sheet rear-end passes through the print head 25. Therefore, it is possible for this embodiment to prevent the adhesion of ink to the transport belt 20 effectively.

On the other hand, in a case where the condition: the measurement value 243>the theoretical value 244 is not satisfied in the step S74 and the condition: the difference between the measurement value 243 and the theoretical value 244>the threshold 230 is satisfied in the step S76, the image forming device 100 of this embodiment determines the rear-end position T using the measurement value 243. It is conceivable that the condition: the difference>the threshold 230 is satisfied in a case where the user erroneously sets up the size of the recording sheet with the wrong one or in a case where the user erroneously places the recording sheet in the wrong orientation of length and width of the recording sheet.

The image forming device of this embodiment is arranged so that the threshold 230 is set to a small value, and when the difference between the measurement value 243 and the theoretical value 244 is not small enough, the measurement value 243 is not used and the theoretical value 244 is used. For example, the threshold 230 in this embodiment is set to about 6 mm. The value of 6 mm is equal to a difference between the length of the short side of A4 size recording sheet and the length of the short side of letter size recording sheet.

The image forming device of this embodiment is arranged in this way, and when a recording sheet with a slightly small size is placed in the sheet tray and the measurement value 243 is used to determine the rear-end position T, the process of cutting image data of a rear-end of an image may be performed in order to prevent the adhesion of ink to the transport belt effectively.

It is conceivable that the value of the above-described threshold 230 changes to some extent from the optimal value due to variations of the mounting accuracy of the filler sensor FS and the sheet sensor, the stroke quantity, the transporting speed, etc. Therefore, it is preferred to set up the value of the threshold 230 with the optimum value that is experimentally acquired from the image forming device.

Figure 8:
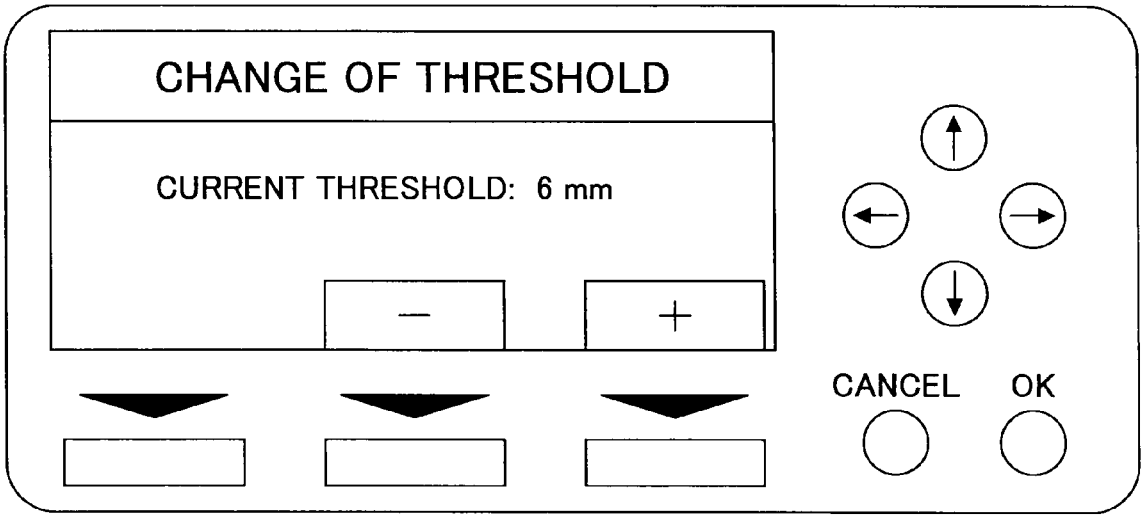
FIG. 8 is a diagram showing an example of an input display screen in which a threshold is input.

FIG. 8 shows an example of an input display screen in which a changed threshold 230 is input. The setting of the threshold 230 to the value input by the user can be carried out suitably. This input display screen may be displayed on the operation panel having a displaying capability in the image forming device of this embodiment. In this case, the input threshold value may be overwritten to the threshold 230 stored in the data storage area 200, and the updated threshold value may be stored therein.

As mentioned above, when a recording sheet with a slightly small size is placed in the sheet tray and the measurement value 243 is used to determine the rear-end position T, the image forming device 100 may determine that it is necessary to perform the process of cutting image data of a rear-end of an image. In such a case, it is preferred to output a display screen as shown in FIG. 9 to the operation unit 38, notifying the user that the image data of the rear-end of the image has been cut.

Figure 9:
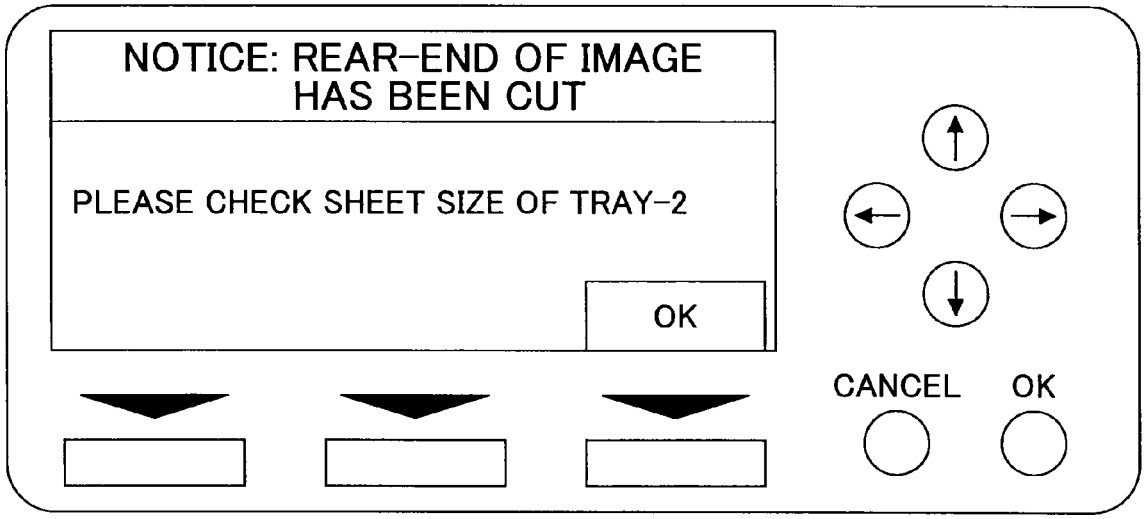
FIG. 9 is a diagram showing an example of a display screen reporting that the rear-end portion of the image has been cut.

FIG. 9 shows an example of a display screen reporting that the rear-end portion of the image has been cut. Alternatively, a LED or a buzzer may be used to notify the user that the rear-end portion of the image has been cut.

As described above, it is possible for the image forming device of the first embodiment to prevent the adhesion of ink to the transport belt effectively.

Next, a description will be given of a second embodiment of the invention. In the second embodiment, only the process at the time of selecting the theoretical value 244 differs from that in the first embodiment. In the second embodiment, the elements which are the same as corresponding elements in the first embodiment are designated by the same reference numerals, and a description thereof will be omitted.

Figure 10:
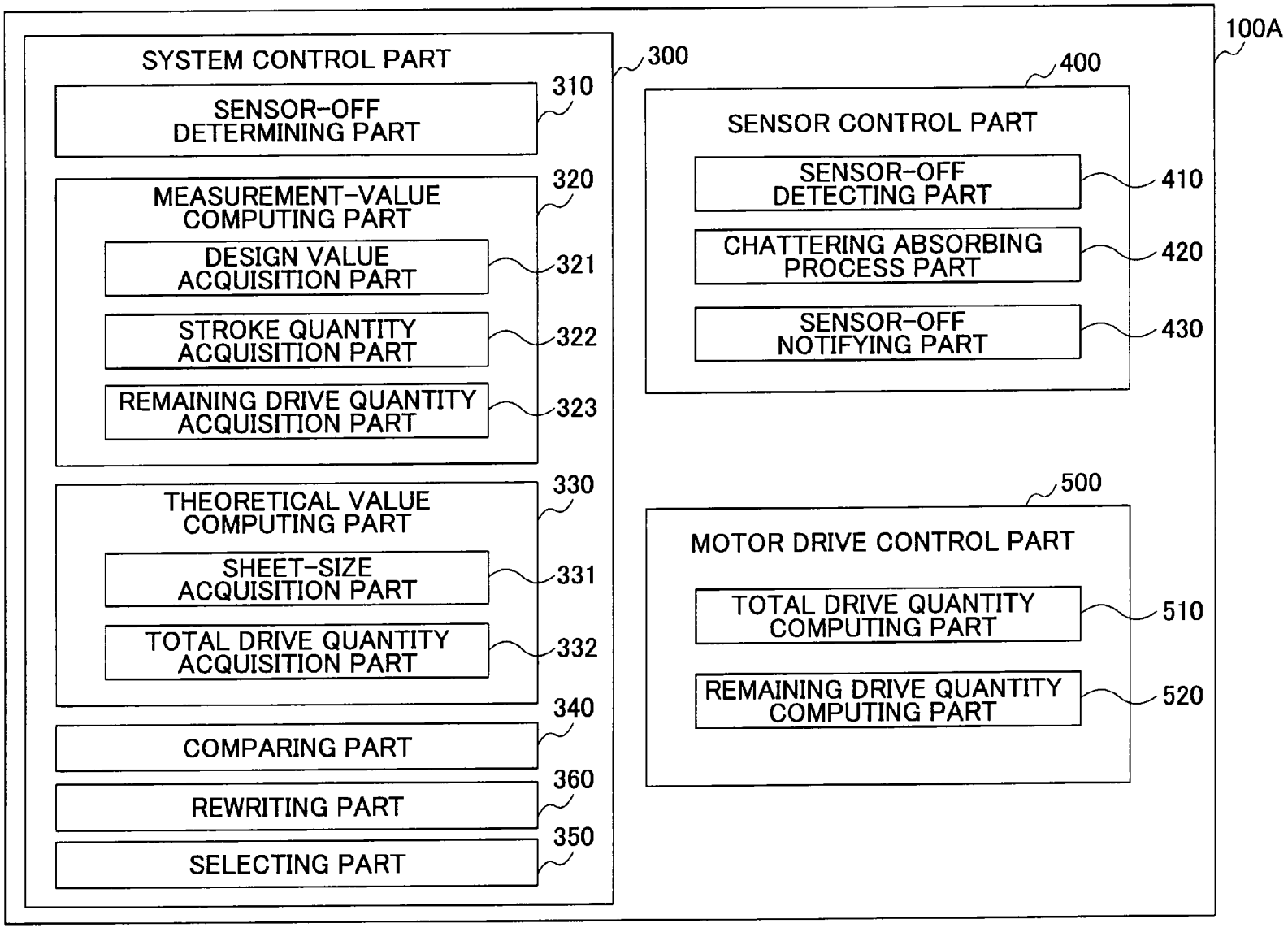
FIG. 10 is a block diagram showing the functional composition of an image forming device of a second embodiment of the invention.

FIG. 10 is a block diagram showing the functional composition of an image forming device 100A of the second embodiment.

In addition to the elements provided in the image forming device 100 of the first embodiment, the image forming device 100A of this embodiment includes a rewriting part 360 as shown in FIG. 10.

When the condition: the measurement value 243>the theoretical value 244 is satisfied, the rewriting part 360 rewrites the threshold 230 stored in the data storage area 200 so as to cause the selecting part 350 to select the theoretical value 244. For example, a candidate value which is a candidate of the changed threshold may be stored beforehand in the data storage area 200, and the rewriting part 360 may rewrite the threshold 230 by overwriting the candidate value to the threshold 230.

Figure 11:
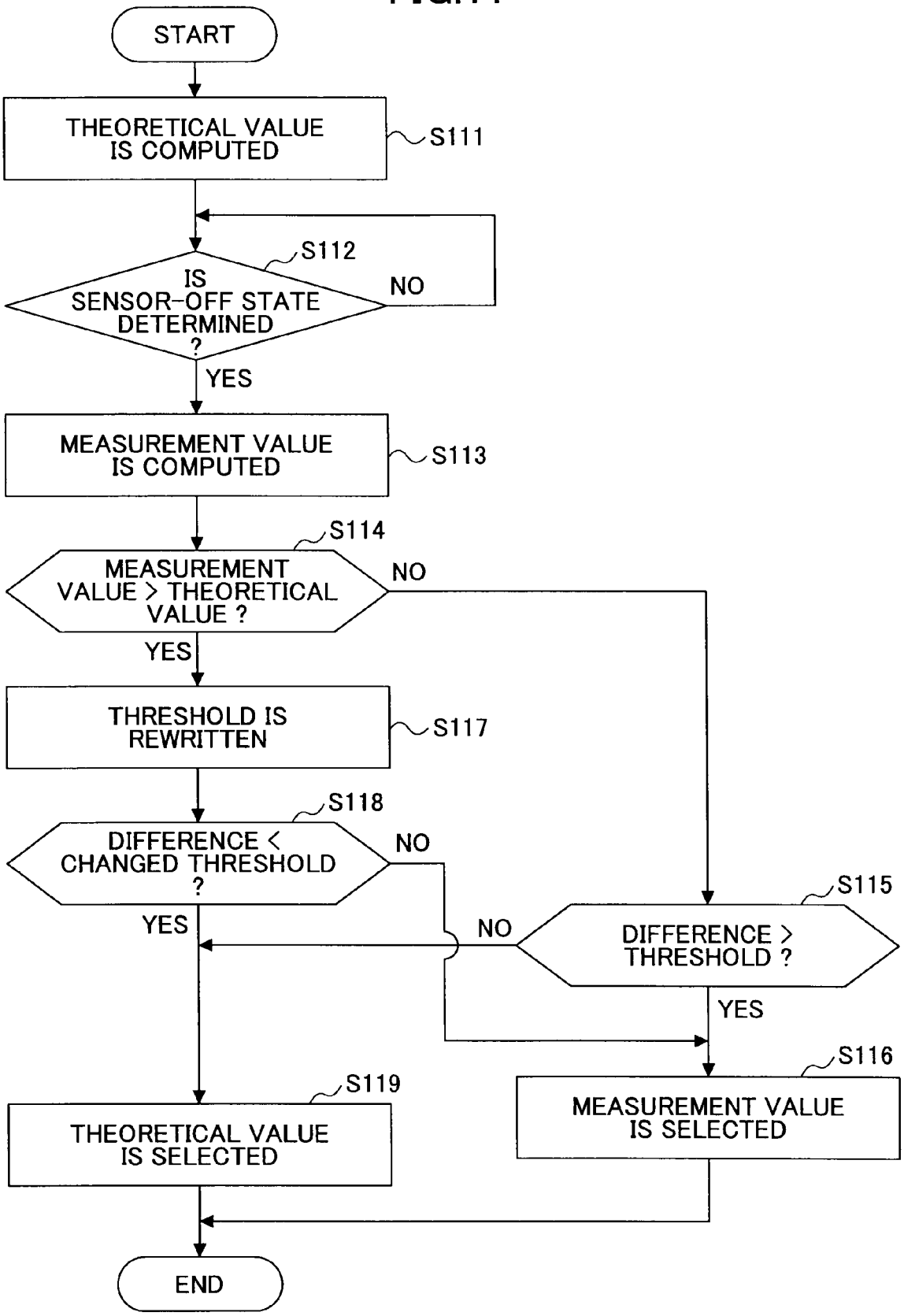
FIG. 11 is a flowchart for explaining operation of the image forming device of the second embodiment.

Operation of the image forming device 100A of this embodiment will be described. FIG. 11 is a flowchart for explaining operation of the image forming device of the second embodiment.

Steps S111 to S116 in the flowchart of FIG. 11 are the same as the steps S71 to S74, step S76 and step S77 in the flowchart of FIG. 7, and a description of these steps will be omitted.

In the flowchart of FIG. 11, when the condition: the measurement value 243>the theoretical value 244 is satisfied in step S114, the rewriting part 360 rewrites the threshold 230 stored in the data storage area 200 (step S117). The rewriting part 360 rewrites the threshold 230 to the value that allows the theoretical value 244 to be selected in step S119 which will be mentioned later. For example, when the currently stored threshold 230 is equal to 6 mm, the rewriting part 360 may rewrite the threshold 230 to be infinity.

After the rewriting of the threshold 230 is completed, the comparing part 340 determines a difference between the measurement value 243 and the theoretical value 244, and determines whether the condition: the difference<the changed threshold (step S118).

When the condition: the difference<the changed threshold is satisfied in the step S118, the selecting part 350 selects the theoretical value 244 (step S119). On the other hand, when the condition: the difference<the changed threshold is not satisfied in the step S118, the control is transferred to step S116 and, in step S116, the selecting part 350 selects the measurement value 243.

The image forming device 100A of this embodiment is arranged so that the threshold 230 is rewritten when the condition: the measurement value 243>the theoretical value 244 is satisfied in the step S114. Therefore, it is possible to set the threshold 230 to a small value. For this reason, the cause of the difference between the measurement value 243 and the theoretical value 244 can be determined more accurately, and the measurement value 243 can be selected in a more appropriate manner.

When the difference between the measurement value 243 and theoretical value 244 is small, an error of measurement at the time of computing the measurement value 243 can be considered as a cause of the difference. When the difference between the measurement value 243 and theoretical value 244 is large, an error of placement of a recording sheet or the like can be considered as a cause of the difference. Because the threshold 230 which is used to determine whether the measurement value 243 is selected or not can be set to a small value in this embodiment, it is not necessary to take into consideration the difference caused by an error of placement of a recording sheet. Therefore, only when the difference is caused by an error of measurement, the threshold 230 can be set to a small value that allows the measurement value 243 to be selected.

The image forming device 100A of this embodiment is arranged so that, in the range of an error of measurement, the rear-end position T can be determined using the measurement value 243. It is possible for this embodiment to detect the rear-end position T more accurately. In this embodiment, the quantity of rear-end margin can be set up accurately. When the measurement value 243 is selected, the image forming device 100A may be arranged to print image data of an entire image without cutting image data of a rear end of an image.

In this embodiment, it is desirable that the threshold 230 be changed to a sufficiently large value that satisfies the condition: the difference<the changed threshold. Alternatively, it may adjust the changed threshold after rewriting appropriately in order to increase a possibility that the measurement value 244 be selected. As mentioned above, when the measurement value 243 is selected, it is possible to print image data of an entire image without cutting image data of a rear end of an image.

Next, a description will be given of a third embodiment of the invention. In the third embodiment, only the process of replacing the threshold 230 by another threshold differs from that in the second embodiment. In the third embodiment, the elements which are the same as corresponding elements in the second embodiment are designated by the same reference numerals, and a description thereof will be omitted.

Figure 12:
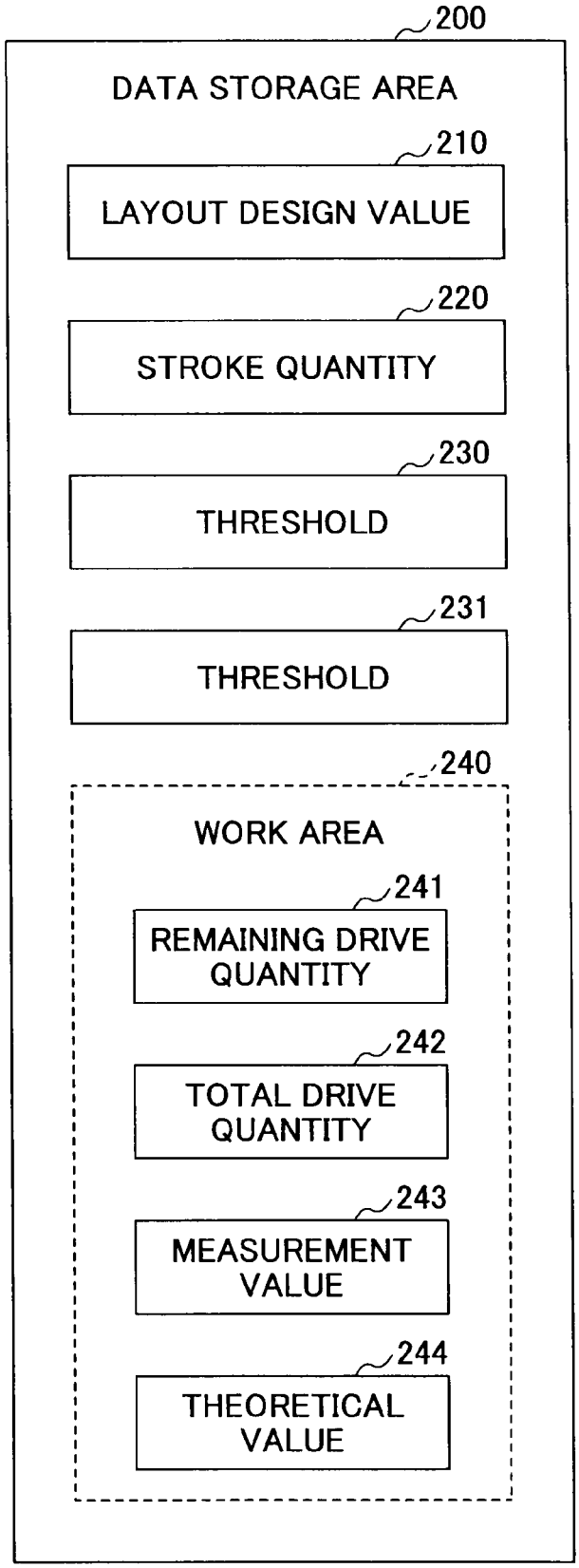
FIG. 12 is a block diagram showing a data storage area arranged in an auxiliary memory of an image forming device of a third embodiment of the invention.

FIG. 12 is a block diagram showing a data storage area arranged in an auxiliary memory of an image forming device of the third embodiment.

As shown in FIG. 12, a threshold 230 and a threshold 231 are stored in the data storage area 200 of this embodiment. The threshold 230 is a threshold used when the condition: the measurement value 243>the theoretical value 244 is not satisfied. The threshold 231 is a threshold used when the condition: the measurement value 243>the theoretical value 244 is satisfied. In this embodiment, the advantages that are the same as those of the second embodiment can be acquired by providing two thresholds in this way.

Figure 13:
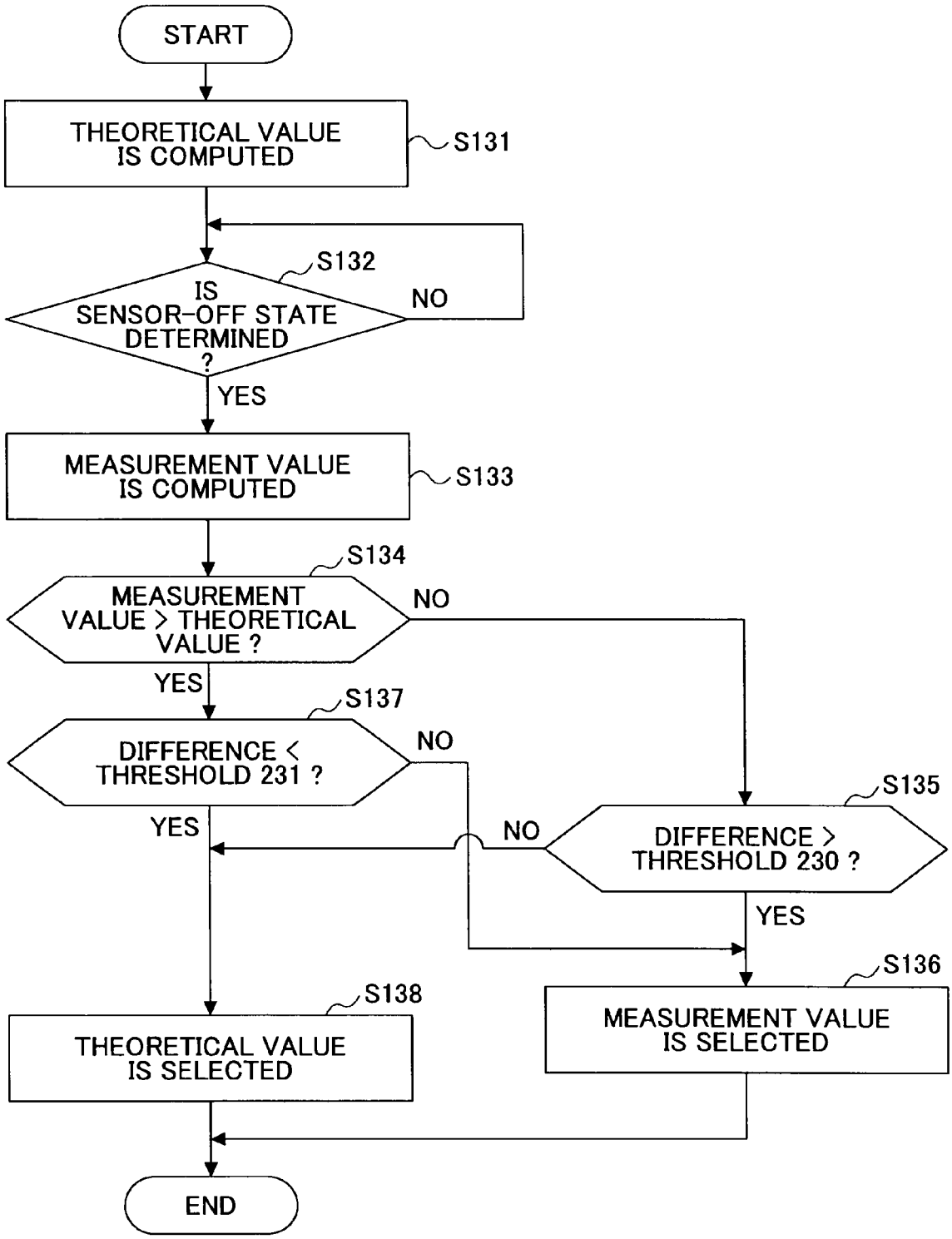
FIG. 13 is a flowchart for explaining operation of the image forming device of the third embodiment.

FIG. 13 is a flowchart for explaining operation of the image forming device of the third embodiment.

Steps S131 to 136 in the flowchart of FIG. 13 are the same as the steps S71 to S74, step S76 and step S77 in the flowchart of FIG. 7, and a description thereof will be omitted.

In the flowchart of FIG. 13, when the condition: the measurement value 243>the theoretical value 244 is satisfied in step S134, the comparing part 340 determines a difference between the measurement value 243 and the theoretical value 244, and determines whether the condition: the difference<the threshold 231 is satisfied, by making reference to the threshold 231 stored in the data storage area 200 (step S137).

When the condition: the difference<the threshold 231 is satisfied in the step S137, the selecting part 350 selects the theoretical value 244 (step S138). On the other hand, when the condition: the difference<the threshold 231 is not satisfied in the step S137, the control is transferred to step S136, and, in step S136, the selecting part 350 selects the measurement value 243.

It is preferred that the threshold 231 in this embodiment is set to a sufficiently large value which satisfies the condition: the difference<the threshold 231.

In this embodiment, the advantages that are the same as those of the second embodiment can be obtained.

Next, a description will be given of a fourth embodiment of the invention. In the fourth embodiment, the threshold is changed in accordance with the transporting speed of the recording sheet.

Usually, when the image writing mode of the image forming device is a high-quality mode, the transporting speed of the recording sheet is changed to a low speed so that a precise image with a high quality is printed. On the other hand, when the image writing mode of the image forming device is a normal mode, the transporting speed of the recording sheet is set to a high speed so that an image with a normal quality is printed.

The image forming device of this embodiment is arranged to include a mode judgment part (not shown) and a threshold changing part (not shown). The mode judgment part determines whether the image writing mode of the image forming device is a high-speed mode or a normal mode. The threshold changing part changes the threshold based on the result of the determination by the mode judgment part. The image forming device of this embodiment is arranged to change the threshold in accordance with the transporting speed of the recording sheet corresponding to the determined image writing mode. For example, for the high-quality mode, the threshold $\alpha 2$ is set to "±8 mm of the difference", and, for the normal mode, the threshold $\alpha 1$ is set to "±10 mm of the difference." For example, the threshold $\alpha 1$ and the threshold $\alpha 2$ may be stored in the data storage area 200.

The quantity of movement of the recording sheet PP1 may be computed based on the transporting speed of the recording sheet and the chattering absorption time, and the threshold may be corrected by adding the computed quantity to the threshold. Specifically, when the chattering absorption time is 20 ms and the transporting time of the recording sheet in the high-quality mode is 200 mm/s, the threshold may be corrected as in the following:

Corrected threshold=initial threshold+200 mm/s×20 ms=initial threshold+4 mm. When the chattering absorption time is 20 ms and the transporting speed of the recording sheet in the normal mode is 300 mm/s, the threshold may be corrected as in the following:

Corrected threshold=initial threshold+300 mm/s×20 ms=initial threshold+6 mm.

It is assumed in the following that the initial threshold is set to a threshold $\alpha$. The threshold $\alpha$ may be stored in the data storage area 200.

Figure 14:
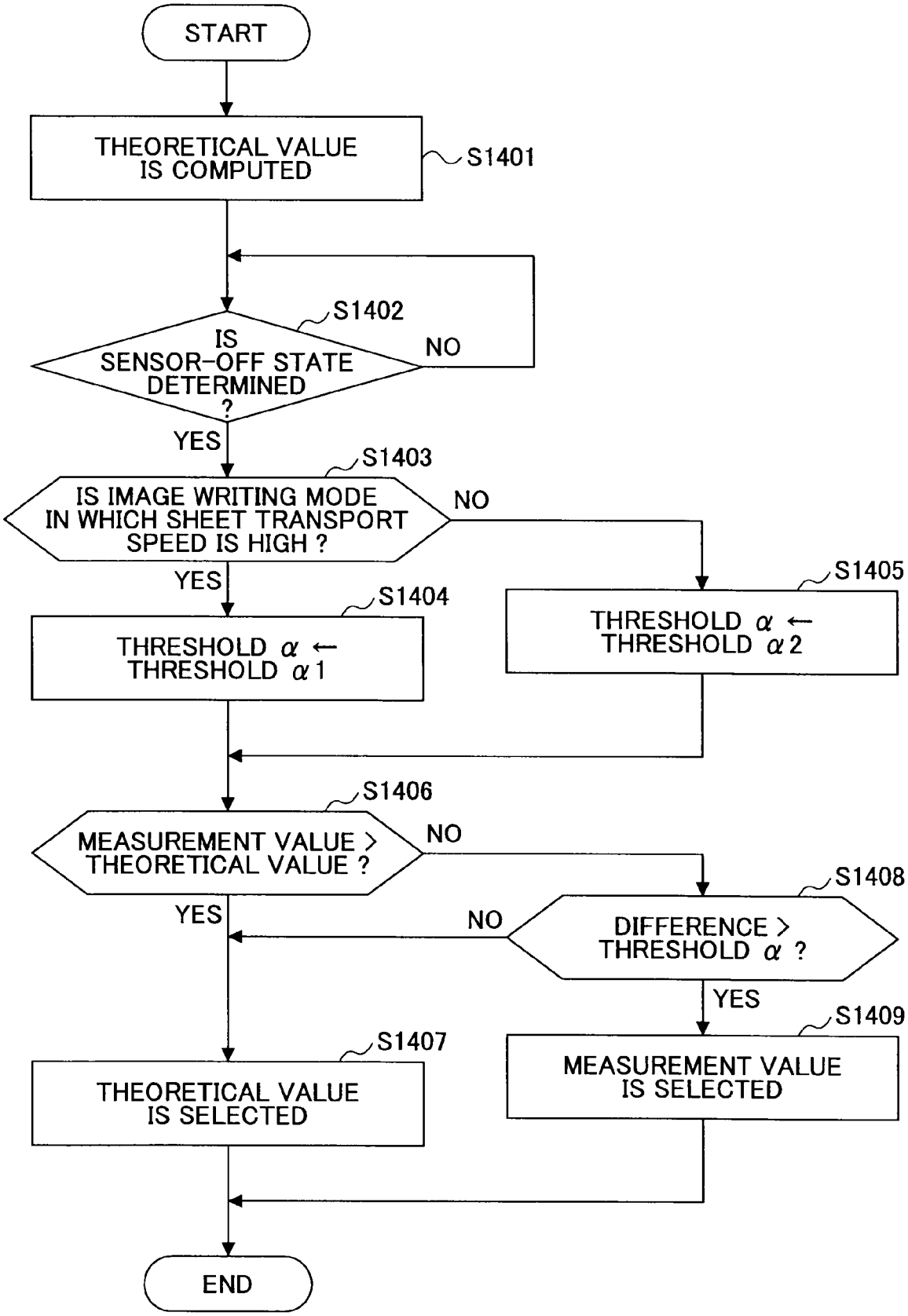
FIG. 14 is a flowchart for explaining operation of an image forming device of a fourth embodiment of the invention.

FIG. 14 is a flowchart for explaining operation of the image forming device of the fourth embodiment.

In the flowchart of FIG. 14, when the transporting of the recording sheet PP1 by the transport belt 20 is started, the theoretical-value computing part 330 serially computes the theoretical value 244 from the total drive quantity and the recording sheet size (step S1401).

The system control part 300 determines whether the sensor-off determining part 310 receives the notice indicating that the OFF state of filler sensor FS is determined, from the sensor-off notifying part 430 of the sensor control part 410 (step S1402). When the sensor-off determining part 310 receives the notice from the sensor-off notifying part 430, the system control part 300 determines that the rear-end of the recording sheet PP1 has passed through the filler sensor FS.

After the OFF state of the filler sensor FS is determined, the mode judgment part determines whether the image writing mode is the normal mode in which the transporting speed of the recording sheet PP1 is high (step S1403).

When the result of the determination in the step S1403 is affirmative, the threshold changing part sets the value of the threshold $\alpha$ to the threshold $\alpha 1$ (step S1404).

When the result of the determination in the step S1403 is negative, the threshold changing part sets the value of the threshold $\alpha$ to the threshold $\alpha 2$ (step S1405).

Subsequently, the comparing part 340 receives the measurement value 243 computed by the measurement-value computing part 320 and the theoretical value 244, and determines whether the condition: the measurement value 243>the theoretical value 244 is satisfied (step S1406).

When the result of the determination in the step S1406 is affirmative, the selecting part 350 selects theoretical value 244 (step S1407).

On the other hand, when the result of the determination in the step S1406 is negative, the comparing part 340 determines a difference between the measurement value 243 and the theoretical value 244, and determines whether the condition: the difference>the threshold $\alpha$ is satisfied (step S1408).

When the result of the determination in the step S1408 is negative, the control is transferred to step S1407 and, in step S1407, the selecting part 350 selects the theoretical value 244.

On the other hand, when the result of the determination in the step S1408 is affirmative, the selecting part 350 selects the measurement value 243 (step S1409).

It is conceivable that the transporting speed changes for every movement in the intermittent transporting process in a certain image printing system. For example, there may be a case in which if the movement in the intermittent transporting process is comparatively large, the transporting speed is the normal speed, but if the movement is minute, the transporting speed is changed to a low speed.

To resolve the problem, the image forming device of this embodiment is arranged to include a speed judgment part which determines whether a transporting speed of a recording sheet when the OFF state of the filler sensor FS is determined is larger than a reference speed. The threshold changing part of this embodiment changes the value of the threshold $\alpha$ based on the result of the determination by the speed judgment part so that the process can be performed appropriately.

In this embodiment, a first range of the transporting speed which is determined as being a high speed, and a second range of the transporting speed which is determined as being a low speed may be stored beforehand in the data storage area 200. The transporting speed may be detected based on the rotational speed of the motor which drives the transporting rollers 21 and 22.

Figure 15:
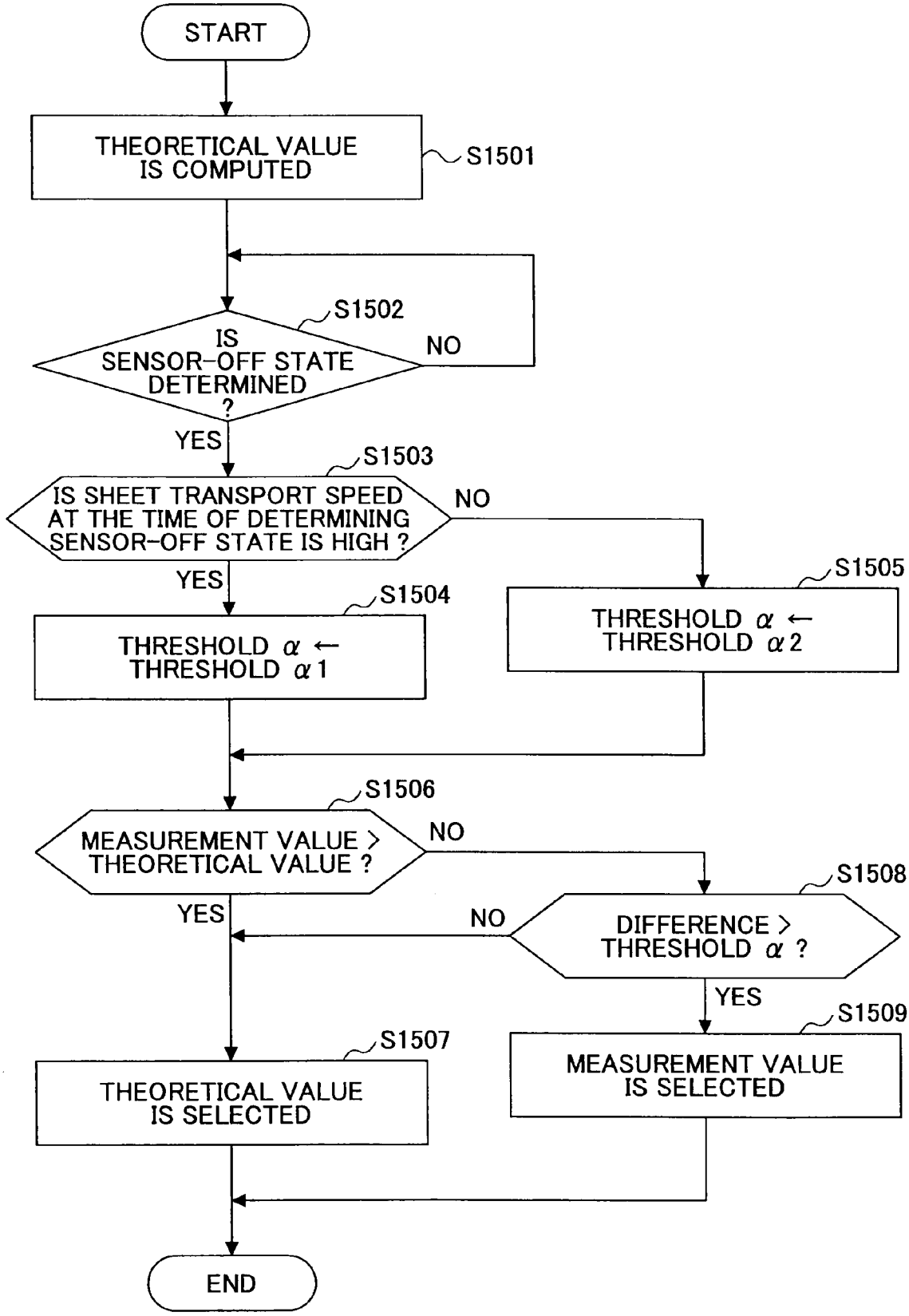
FIG. 15 is a flowchart for explaining another operation of the image forming device of the fourth embodiment.

An example of the process in this case will be described. FIG. 15 is a flowchart for explaining another operation of the image forming device of the fourth embodiment.

In the flowchart of FIG. 15, when the transporting of the recording sheet PP1 by the transport belt 20 is started, the theoretical-value computing part 330 serially computes the theoretical value 244 from the total drive quantity and the recording sheet size (step S1501).

The system control part 300 determines whether the sensor-off determining part 310 receives the notice indicating that the OFF state of the filler sensor FS is determined, from the sensor-off notifying part 430 of the sensor control part 410 (step S1502). When the sensor-off determining part 310 receives the notice from the sensor-off notifying part 430, the system control part 300 determines that the rear-end of the recording sheet PP1 has passed through the filler sensor FS.

Subsequently, the speed judgment part determines whether the transporting speed of the recording sheet at this time is larger than the reference speed (step S1503). When the result of the determination in the step S1503 is affirmative, the threshold changing part sets the value of the threshold $\alpha$ to the threshold $\alpha$1 (step S1504).

When the result of the determination in the step S1503 is negative, the threshold changing part sets the value of the threshold $\alpha$ to the threshold $\alpha$2 (step S1505).

Subsequently, the comparing part 340 receives the measurement value 243 computed by the measurement-value computing part 320 and the theoretical value 244, and determines whether the condition: the measurement value 243>the theoretical value 244 is satisfied (step S1506).

When the result of the determination in the step S1506 is affirmative, the selecting part 350 selects the theoretical value 244 (step S1507).

On the other hand, when the result of the determination in the step S1506 is negative, the comparing part 340 determines a difference between the measurement value 243 and the theoretical value 244, and determines whether the condition: the difference>the threshold $\alpha$ is satisfied (step S1508).

When the result of the determination in the step S1508 is negative, the control is transferred to step S1507 and, in step S1507, the selecting part 350 selects the theoretical value 244.

When the result of the determination in the step S1508 is affirmative, the selecting part 350 selects the measurement value 243 (step S1509).

The present invention is not limited to the specifically disclosed embodiments, and variations and modifications may be made without departing from the scope of the present invention.

The present application is based on Japanese patent application No. 2008-023782, filed on Feb. 4, 2008, and Japanese patent application No. 2008-282107, filed on Oct. 31, 2008, the contents of which are incorporated herein by reference in their entirety.

What is claimed is:

1. An image forming device which prints an image on a recording sheet by performing a reciprocating movement of a print head in a main scanning direction while transporting the recording sheet intermittently in a transporting direction, comprising:

a filler sensor disposed at an upstream position of the print head in the transporting direction to detect that the recording sheet has passed through a first position;

a measurement-value computing unit configured to compute a measurement value indicating a distance from a second position of a sensor, disposed near the print head, to a rear-end position of the recording sheet in the transporting direction, by using a computed distance between the second position and the first position;

a theoretical-value computing unit configured to compute a theoretical value indicating the distance from the second position to the rear-end position of the recording sheet, by using a quantity of transporting of the recording sheet; and a selecting unit configured to select one of the measurement value and the theoretical value based on a result of comparison between the measurement value and the theoretical value, so that the selected value is used as a value that indicates the rear-end position of the recording sheet.

2. The image forming device according to claim 1, wherein the selecting unit selects the theoretical value when the theoretical value is smaller than the measurement value.

3. The image forming device according to claim 2, further comprising a memory unit in which a first threshold is stored, wherein the selecting unit selects the measurement value when the theoretical value is larger than the measurement value and a difference between the theoretical value and the measurement value is larger than the first threshold stored in the memory unit.

4. The image forming device according to claim 3, further comprising a rewriting unit configured to rewrite the first threshold stored in the memory unit, when the theoretical value is smaller than the measurement value, wherein the selecting unit selects the theoretical value when the theoretical value is smaller than the measurement value and the difference between the theoretical value and the measurement value is smaller than the first threshold rewritten by the rewriting unit.

5. The image forming device according to claim 4, wherein the rewriting unit rewrites the first threshold and the changed first threshold after rewriting is larger than the first threshold before rewriting.

6. The image forming device according to claim 5, wherein a second threshold that is larger value than the first threshold is stored in the memory unit, and the selecting unit selects the theoretical value when the theoretical value is smaller than the measurement value and the difference between the theoretical value and the measurement value is smaller than the second threshold.

7. The image forming device according to claim 1, further comprising a motor drive control unit configured to control a drive of a motor which transports the recording sheet, wherein the motor drive control unit comprises a remaining drive quantity computing unit configured to compute a drive quantity for driving the motor.

8. The image forming device according to claim 7, wherein the motor drive control unit comprises a total drive quantity computing unit configured to compute a drive quantity which is consumed for driving the motor.

9. The image forming device according to claim 7, wherein the measurement-value computing unit comprises:

a stroke quantity acquisition unit configured to acquire a predetermined stroke quantity of the filler sensor; and a remaining drive quantity acquisition unit configured to acquire a drive quantity computed by the remaining drive quantity computing unit when the filler sensor detects that the recording sheet has passed through the first position;

wherein the measurement value is computed by subtracting from the distance between the second position and the first position a distance by which the recording sheet is transported in response to the stroke quantity and the remaining drive quantity.

10. The image forming device according to claim 8, wherein the theoretical-value computing unit comprises:

a sheet-size acquisition unit configured to acquire a length of the recording sheet in a sub-scanning direction; and a total drive quantity acquisition unit configured to acquire a drive quantity computed by the total drive quantity computing unit;

wherein the theoretical value is computed by subtracting from the length of the recording sheet in the sub-scanning direction a distance by which the recording sheet is transported in response to the drive quantity.

11. A transporting control method for use in an image forming device which prints an image on a recording sheet by performing a reciprocating movement of a print head in a main scanning direction while transporting the recording sheet intermittently in a transporting direction, comprising the steps of:

providing a filler sensor disposed at an upstream position of the print head in the transporting direction to detect that the recording sheet has passed through a first position;

computing a measurement value indicating a distance from a second position of a sensor, disposed near the print head, to a rear-end position of the recording sheet in the transporting direction, by using a computed distance between the second position and the first position;

computing a theoretical value indicating the distance from the second position to the rear-end position of the recording sheet, by using a quantity of transporting of the recording sheet; and selecting one of the measurement value and the theoretical value based on a result of comparison between the measurement value and the theoretical value, so that the selected value is used as a value that indicates the rear-end position of the recording sheet.

12. A computer-readable recording medium storing a transporting control program which, when executed by a computer, causes the computer to perform the transporting control method according to claim 11.

* * * * *